US012221910B2

(12) United States Patent
Ozeki

(10) Patent No.: US 12,221,910 B2
(45) Date of Patent: Feb. 11, 2025

(54) VARIABLE VALVE DEVICE

(71) Applicant: SUZUKI MOTOR CORPORATION, Hamamatsu (JP)

(72) Inventor: Hisashi Ozeki, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 4 days.

(21) Appl. No.: 18/460,176

(22) Filed: Sep. 1, 2023

(65) Prior Publication Data

US 2024/0077003 A1 Mar. 7, 2024

(30) Foreign Application Priority Data

Sep. 6, 2022 (JP) ..... 2022-141432

(51) Int. Cl.

| | |
|---|---|
| ***F01L 1/24*** | (2006.01) |
| ***F01L 1/26*** | (2006.01) |
| ***F01L 1/34*** | (2006.01) |
| ***F01L 1/344*** | (2006.01) |
| ***F01L 13/00*** | (2006.01) |
| *F01L 1/053* | (2006.01) |
| *F01L 1/18* | (2006.01) |

(52) U.S. Cl.

CPC ..... *F01L 1/344* (2013.01); *F01L 1/2405* (2013.01); *F01L 1/267* (2013.01); *F01L 1/34* (2013.01); *F01L 13/0036* (2013.01); *F01L 1/053* (2013.01); *F01L 1/181* (2013.01); *F01L 2001/186* (2013.01); *F01L 13/0005* (2013.01); *F01L 2305/00* (2020.05)

(58) Field of Classification Search

CPC . F01L 1/2405; F01L 1/053; F01L 1/34; F01L 1/267; F01L 1/181; F01L 13/0036; F01L 2001/186

See application file for complete search history.

(56) References Cited

U.S. PATENT DOCUMENTS

2024/0077002 A1* 3/2024 Ozeki ..... F01L 1/053

FOREIGN PATENT DOCUMENTS

JP 5907552 B2 4/2016
WO WO-2017065168 A1 * 4/2017 ..... F01L 1/181

* cited by examiner

*Primary Examiner* — Ngoc T Nguyen
(74) *Attorney, Agent, or Firm* — Stein IP, LLC

(57) ABSTRACT

A variable valve device includes a pair of cam housings separated in a predetermined direction, a rocker shaft supported by the pair of cam housings, rocker arms supported by the rocker shaft, a connecting pin disposed in a pin hole of one of the rocker arms, a return pin disposed in a pin hole of another of the rocker arms, a pressing member that causes the connecting pin to push the return pin to the other side, a repulsive member that causes the return pin to push back the connecting pin to one side, and an upper housing supported at both ends by upper surfaces of the pair of cam housings. In the variable valve device, the upper housing is formed with a first accommodation hole in which the pressing member is disposed and a second accommodation hole in which the repulsive member is disposed.

9 Claims, 14 Drawing Sheets

VARIABLE VALVE DEVICE

CROSS-REFERENCE TO RELATED APPLICATIONS

The disclosure of Japanese Patent Application No. 2022-141432 filed on Sep. 6, 2022, including specification, drawings and claims is incorporated herein by reference in its entirety.

TECHNICAL FIELD

The present invention relates to a variable valve device.

BACKGROUND ART

In related art, there is known a variable valve device in which a plurality of rocker arms are connected to each other to switch valve operations (see, for example, JP5907552B). In a variable valve device described in JP5907552B, a pair of rocker arms are arranged adjacent to each other, and a connecting pin is disposed in a pin hole of one rocker arm. By pushing a part of the connecting pin into a pin hole of the other rocker arm, the pair of rocker arms are connected and a pair of valves are simultaneously operated. By pulling out the part of the connecting pin from the pin hole of the other rocker arm, a connected state of the pair of rocker arms is released, and only one valve is operated.

SUMMARY

A spring pin for pushing back the connecting pin is disposed in the pin hole of the other rocker arm described in JP5907552B. Therefore, the rocker arm is increased in a size, and a mass of a moving portion of a valve system is increased, so that the above variable valve device is not suitable for a high-speed engine. In this case, a structure is also conceivable in which a return pin is disposed in the pin hole of the other rocker arm and the spring pin is disposed outside the other rocker arm. The connecting pin is pushed in from one side by a drive pin, so that it is difficult to achieve a parallelism between the drive pin and the spring pin, and there is a possibility that components are worn due to partial contact.

An object of the present embodiment is to provide a variable valve device capable of preventing an increase in a size of a rocker arm and preventing wear due to partial contact between components.

An aspect of a present embodiment which can solve the above technical problem is a variable valve device capable of changing valve operations of an intake valve and an exhaust valve in a cylinder head, the variable valve device including a pair of cam housings separated in a predetermined direction in the cylinder head, a rocker shaft supported by opposing portions of the pair of cam housings, a plurality of rocker arms swingably supported by the rocker shaft, a connecting pin disposed in a pin hole of a rocker arm closer to one side in a predetermined direction, a return pin disposed in a pin hole of a rocker arm closer to the other side in the predetermined direction, a pressing member configured to cause the connecting pin to push the return pin to the other side, a repulsive member configured to cause the return pin to push back the connecting pin to one side, and an upper housing supported at both ends by upper surfaces of the pair of cam housings. In the variable valve device, the upper housing is formed with a first accommodation hole in which the pressing member is disposed on one side with respect to the rocker arm closer to one side and a second accommodation hole in which the repulsive member is disposed on the other side with respect to the rocker arm closer to the other side.

According to the variable valve device of the aspect of the present embodiment, when the return pin is pushed to the other side via the connecting pin by the pressing member, the connecting pin partially enters from the pin hole of the rocker arm closer to one side into the pin hole of the rocker arm closer to the other side, so that the plurality of rocker arms are connected. When the connecting pin is pushed back to the one side via the return pin by the repulsive member, the connecting pin is pulled out from the pin hole of the rocker arm closer to the other side, so that the connection of the plurality of rocker arms is released. In this way, a connected state and a released state of the plurality of rocker arms can be switched with a simple configuration. In addition, since the first accommodation hole and the second accommodation hole are formed in the upper housing, a parallelism between components is easily achieved, and wear due to partial contact between the components is prevented.

DETAILED DESCRIPTION OF EMBODIMENTS

A variable valve device of one aspect of the present invention changes valve operations of an intake valve and an exhaust valve in a cylinder head. A pair of cam housings are separated in a predetermined direction in the cylinder head, and a rocker shaft is supported by opposing portions of the pair of cam housings. A plurality of rocker arms are swingably supported by the rocker shaft, a connecting pin is disposed in a pin hole of a rocker arm closer to one side in a predetermined direction, and a return pin is disposed in a pin hole of a rocker arm closer to the other side in the predetermined direction. When the return pin is pushed to the other side via the connecting pin by a pressing member, the connecting pin partially enters from the pin hole of the rocker arm closer to one side into the pin hole of the rocker arm closer to the other side, so that the plurality of rocker arms are connected. When the connecting pin is pushed back to one side via the return pin by a repulsive member, the connecting pin is pulled out from the pin hole of the rocker arm closer to the other side, so that the connection of the plurality of rocker arms is released. In this way, a connected state and a released state of the plurality of rocker arms can be switched with a simple configuration. In addition, an upper housing is supported at both ends by upper surfaces of the pair of cam housings. In the upper housing, the pressing member is disposed in a first accommodation hole on one side with respect to the rocker arm closer to one side, and the repulsive member is disposed in a second accommodation hole on the other side with respect to the rocker arm closer to the other side. Since the first accommodation hole and the second accommodation hole are formed in the upper housing, a parallelism between components is easily achieved, and wear due to partial contact between the components is prevented.

Embodiments

Figure 1:
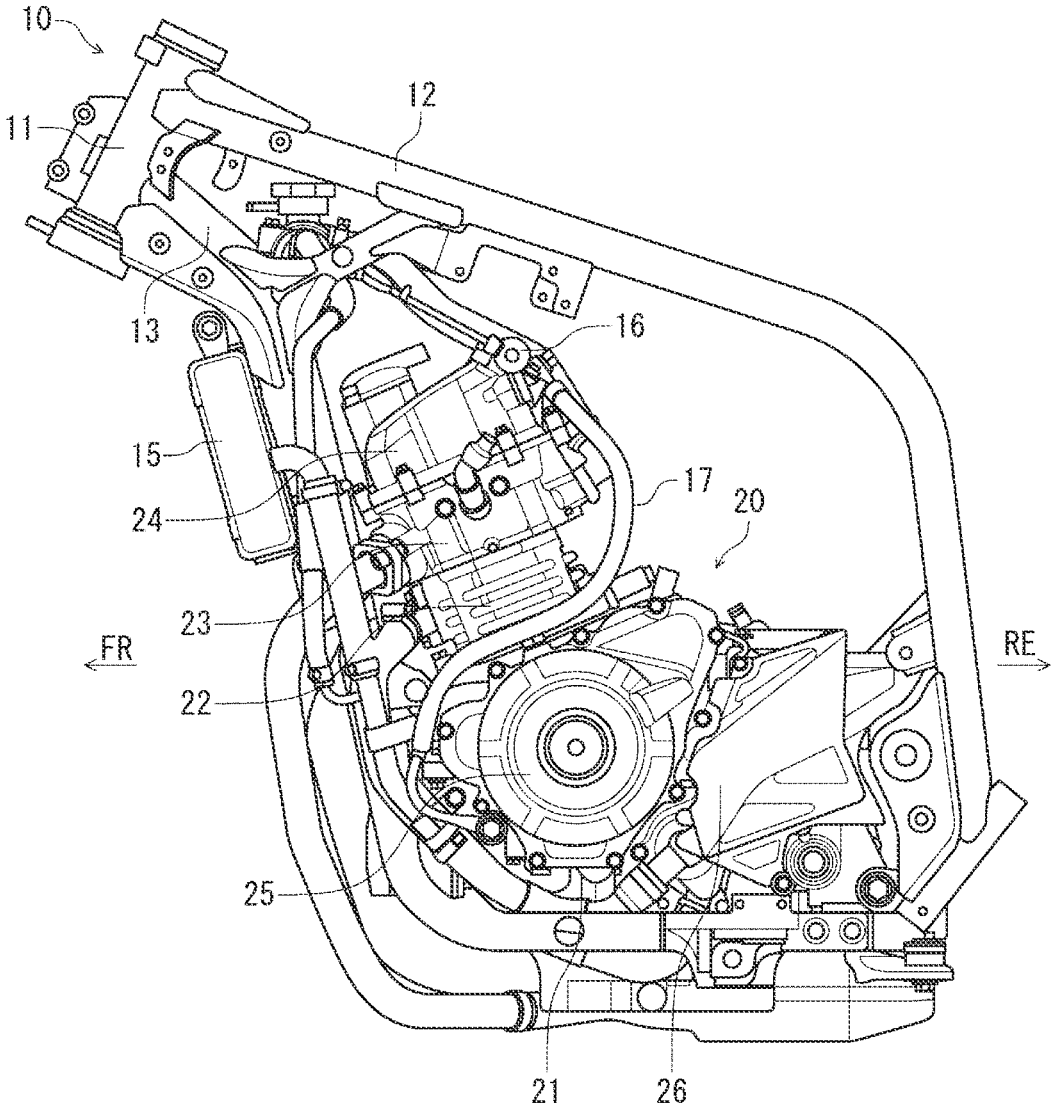
FIG. 1 is a left side view of an engine and a vehicle body frame according to an embodiment.
Figure 2:
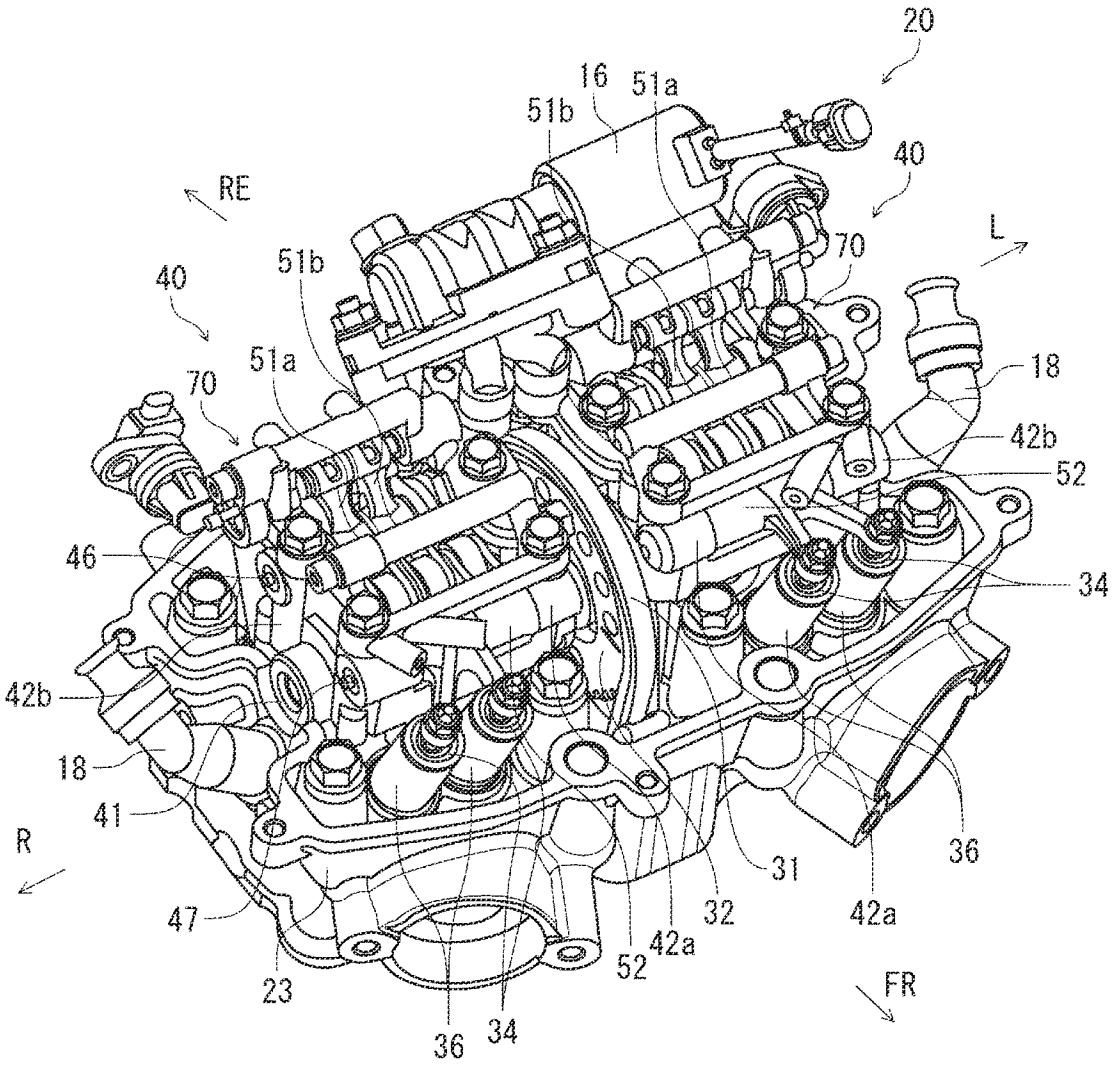
FIG. 2 is a perspective view of an inside of a cylinder head according to the present embodiment.
Figure 3:
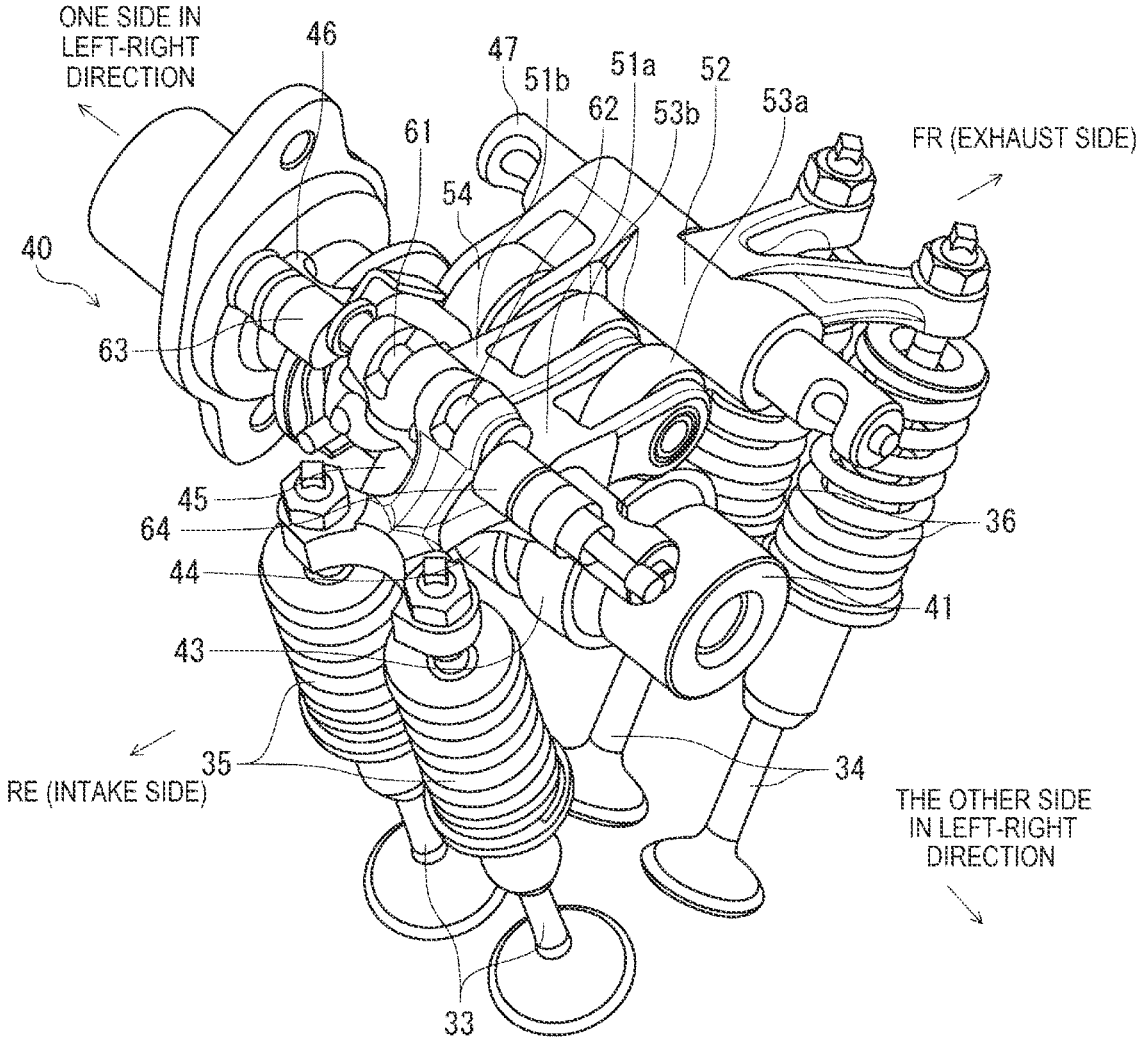
FIG. 3 is a perspective view of a variable valve device according to the present embodiment.

Hereinafter, an embodiment will be described in detail with reference to the accompanying drawings. FIG. 1 is a left side view of an engine and a vehicle body frame according to the present embodiment. FIG. 2 is a perspective view of an inside of a cylinder head according to the present embodiment. FIG. 3 is a perspective view of a variable valve device according to the present embodiment. In the following drawings, an arrow FR indicates a vehicle front side, an arrow RE indicates a vehicle rear side, an arrow L indicates a vehicle left side, and an arrow R indicates a vehicle right side. In addition, in the following description, a center side in a left-right direction of the cylinder head is referred to as one side, and an outer side in the left-right direction of the cylinder head is referred to as the other side.

As shown in FIG. 1, a straddle-type vehicle is formed by mounting various components such as an engine 20 and an electrical system on a cradle-type vehicle body frame 10. The vehicle body frame 10 includes a main tube 12 that extends rearward from an upper portion of a head pipe 11 and then bends downward, and a down tube 13 that extends downward from a lower portion of the head pipe 11 and then bends rearward. A rear end portion of the down tube 13 is joined to a lower end portion of the main tube 12 to form an installation space for the engine 20 inside the vehicle body frame 10. A rear side of the engine 20 is supported by the main tube 12, and a front side and a lower side of the engine 20 are supported by the down tube 13.

The engine 20 is a parallel two-cylinder engine, and includes a crankcase 21, a cylinder 22 provided on the crankcase 21, a cylinder head 23 provided on the cylinder 22, and a cylinder head cover 24 provided on the cylinder head 23. A magnet cover 25 that covers a magnet (not shown) from a lateral side is attached to a left side surface of the crankcase 21. A sprocket cover 26 that covers a drive sprocket (not shown) from a lateral side is attached to the rear of the magnet cover 25. A clutch cover (not shown) that covers a clutch (not shown) from a lateral side is attached to a right side surface of the crankcase 21.

A radiator 15 that radiates heat of cooling water of the engine 20 is disposed in front of the engine 20. An oil control valve 16 that controls a hydraulic pressure to variable valve devices 40 is disposed on an outer surface of the cylinder head cover 24. An oil is supplied to the oil control valve 16 from a main gallery of the crankcase 21 through an external pipe 17. A valve chamber is formed inside the cylinder head 23 and the cylinder head cover 24. The variable valve device 40 (see FIG. 3) that changes valve operations of intake valves 33 (see FIG. 3) and exhaust valves 34 (see FIG. 3) by the hydraulic pressure is mounted on the valve chamber.

As shown in FIG. 2, the engine 20 is a four-valve two-cylinder engine, and a cam chain 31 is disposed between two cylinders. The cam chain 31 is wound around a cam sprocket 32, and the variable valve device 40 is disposed for each of the left and right cylinders with the cam sprocket 32 interposed therebetween. The variable valve device 40 is provided with a camshaft 41 that rotates integrally with the cam sprocket 32. In the cylinder head 23, cam housings 42*a* and 42*b* are separated in a left-right direction (a predetermined direction) for each cylinder, and the camshaft 41 is rotatably supported by mating surfaces of the cam housings 42*a* and 42*b* and the cylinder head 23.

In the cylinder head 23, four intake valves 33 (see FIG. 3) are arranged behind the camshaft 41, and four exhaust valves 34 are arranged in front of the camshaft 41. The intake valve 33 is pressed in a valve-closing direction by a valve spring 35 (see FIG. 3), and the exhaust valve 34 is pressed in a valve-closing direction by a valve spring 36. A low-speed cam 43, a high-speed cam 44, and an exhaust cam 45 (all of which are shown in FIG. 3) are formed on an outer circumferential surface of the camshaft 41. Each of the cams 43 to 45 is formed in a plate-like shape with a cam ridge protruding from a part of a base circle. The cam ridge of the high-speed cam 44 is higher than that of the low-speed cam 43 so that a valve lift amount of the high-speed cam 44 is larger than that of the low-speed cam 43.

A rocker shaft 46 on an intake side and a rocker shaft 47 on an exhaust side are supported by opposing portions of the cam housings 42*a* and 42*b*. The rocker shaft 46 on the intake side and the rocker shaft 47 on the exhaust side are located above the camshaft 41, and the rocker shaft 46 on the intake side and the rocker shaft 47 on the exhaust side extend parallel to the camshaft 41. In addition, left and right side walls of the cylinder head 23 are recessed in a concave shape, and a pair of plug covers 18 are arranged in recesses of the cylinder head 23. The oil control valve 16 that supplies the oil to the variable valve device 40 is disposed behind the cylinder head 23.

As shown in FIGS. 2 and 3, two types of rocker arms 51*a* and 51*b* (only one of each is shown in FIG. 3) are swingably supported by the rocker shaft 46 on the intake side, and a rocker arm 52 (only one is shown in FIG. 3) is swingably supported by the rocker shaft 47 on the exhaust side. The rocker arm 51*a* on the intake side and the rocker arm 52 on the exhaust side are formed in a seesaw shape having a force point and an action point, and the rocker arm 51*b* on the intake side serves as a force point of the rocker arm 51*a*. Both a left end of the rocker arm 51*a* on the intake side and a right end of the rocker arm 52 on the exhaust side are bifurcated.

A roller 53*a* that is in rolling contact with the low-speed cam 43 is rotatably supported at one end of the rocker arm 51*a* on the intake side, and a pair of intake valves 33 are connected to the other end of the rocker arm 51*a* which is bifurcated. A roller 53*b* that is in rolling contact with the high-speed cam 44 is rotatably supported at one end of the rocker arm 51*b* on the intake side, and the intake valve 33 is not connected to the other end of the rocker arm 51*b*. A roller 54 that is in rolling contact with the exhaust cam 45 is rotatably supported at one end of the rocker arm 52 on the exhaust side, and a pair of exhaust valves 34 are connected to the other end of the rocker arm 52 which is bifurcated. The rocker arms 51*a* and 51*b* are formed in a connectable manner.

When the engine rotates at a low speed and a medium speed, the rocker arms 51*a* and 51*b* are not connected. Therefore, the rocker arm 51*a* is swung by the low-speed cam 43, and the rocker arm 51*b* is swung by the high-speed cam 44. Since the pair of intake valves 33 are connected to the rocker arm 51*a*, the pair of intake valves 33 are moved according to rotation of the low-speed cam 43. Since the cam ridge of the low-speed cam 43 is low, valve lift amounts of the pair of intake valves 33 are low. Since the intake valve 33 is not connected to the rocker arm 51*b*, the rocker arm 51*b* is idle according to rotation of the high-speed cam 44.

When the engine rotates at a high speed, the rocker arms 51*a* and 51*b* are connected. Therefore, the rocker arms 51*a* and 51*b* are swung integrally by the high-speed cam 44. Since the pair of intake valves 33 are connected to the rocker arm 51*b* via the rocker arm 51*a*, the pair of intake valves 33 are moved according to the rotation of the high-speed cam 44. Since the cam ridge of the high-speed cam 44 is high, the valve lift amounts of the pair of intake valves 33 are high. In this way, by switching a connected state of the rocker arms 51*a* and 51*b*, the low-speed cam 43 and the high-speed cam 44 for moving the intake valves 33 are switched.

Each of the variable valve devices 40 is provided with a switching mechanism that switches between the connected state and a non-connected state of the rocker arms 51*a* and 51*b* according to the hydraulic pressure. A connecting pin 61 is disposed in a pin hole of the rocker arm 51*b* closer to one side (closer to a center) in a left-right direction (a predetermined direction) of the cylinder head 23, and a return pin 62 is disposed in a pin hole of the rocker arm 51*a* closer to the other side (closer to an outer side) in the left-right direction of the cylinder head 23. A hydraulic piston (a pressing member) 63 is disposed on one side with respect to the rocker arm 51*b*, and a spring pin (a repulsive member) 64 with a spring is disposed on the other side with respect to the rocker arm 51*a*.

The hydraulic piston 63 causes the connecting pin 61 to push the return pin 62 to the other side, and the spring pin 64 causes the return pin 62 to push back the connecting pin 61 to one side. By pushing the connecting pin 61 by the hydraulic piston 63, a part of the connecting pin 61 enters the pin hole of the rocker arm 51*a* from the pin hole of the rocker arm 51*b*, so that the rocker arms 51*a* and 51*b* are connected. By pushing back the connecting pin 61 by the spring pin 64 via the return pin 62, the part of the connecting pin 61 is pulled out from the pin hole of the rocker arm 51*a*, so that the connection of the rocker arms 51*a* and 51*b* is released.

The hydraulic piston 63 and the spring pin 64 are separated greatly in a left-right direction. In a case where the hydraulic piston 63 and the spring pin 64 are arranged as separate members, it is difficult to achieve a parallelism between the hydraulic piston 63 and the spring pin 64, and there is a possibility that components are worn due to partial contact. Therefore, in the variable valve device 40 according to the present embodiment, an upper housing 70 is supported at both ends by upper surfaces of the cam housings 42*a* and 42*b*, and the hydraulic piston 63 and the spring pin 64 are arranged on the upper housing 70. By arranging the hydraulic piston 63 and the spring pin 64 as the same member, the parallelism between the hydraulic piston 63 and the spring pin 64 is ensured.

When an oil is continuously injected from the camshaft 41 to lubricate the rocker arms 51*a*, 51*b*, and 52 by droplets of the oil, there is a possibility that an operating rotation speed of the variable valve device 40 cannot be obtained due to a decrease in a hydraulic pressure of the engine 20. Further, adhesion of the oil to the cam increases a mechanical loss, and there is a possibility that important components are worn due to insufficient lubrication. Therefore, the upper housing 70 according to the present embodiment is formed in a ladder shape, and a lubricating oil is supplied from a bridge portion of the upper housing 70 along the rocker shafts 46 and 47 and the camshaft 41 to required locations of valve components.

Figure 4A:
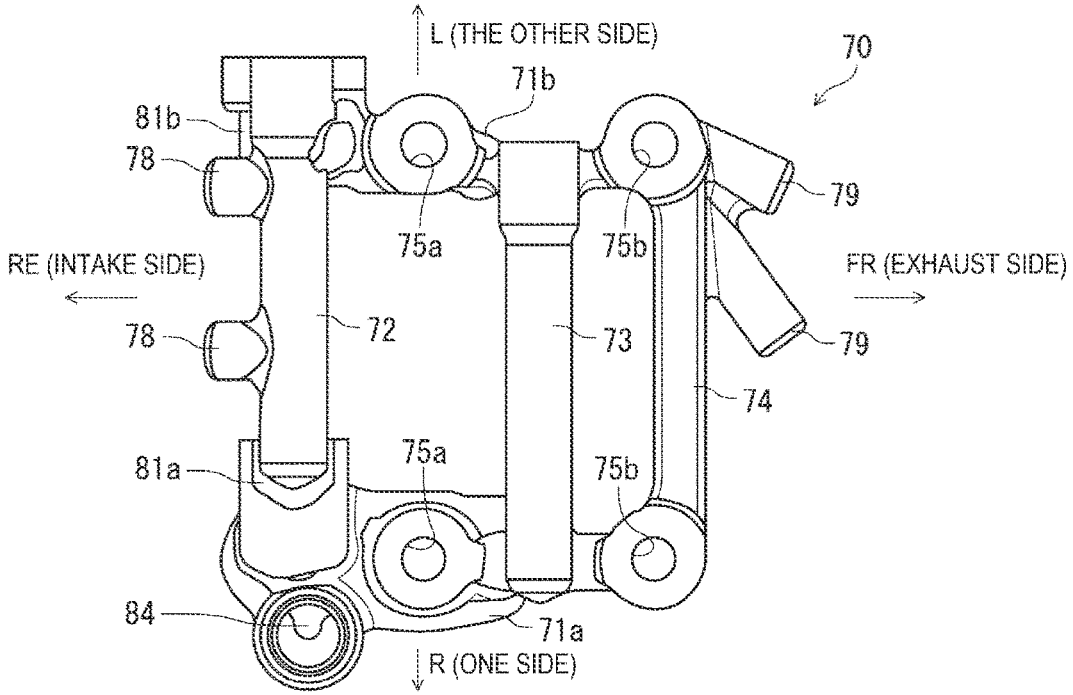
FIGS. 4A and 4B show a top view and a bottom view of an upper housing according to the present embodiment.
Figure 4B:
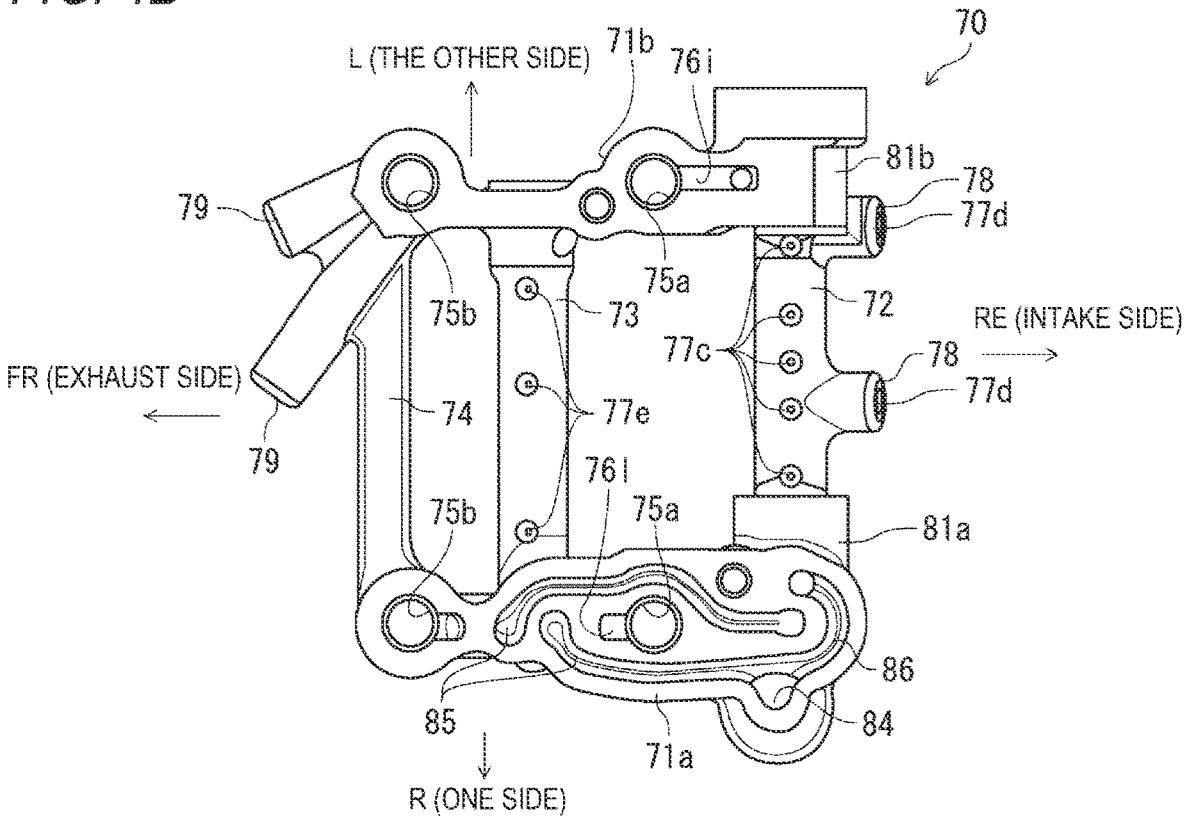
Figure 5:
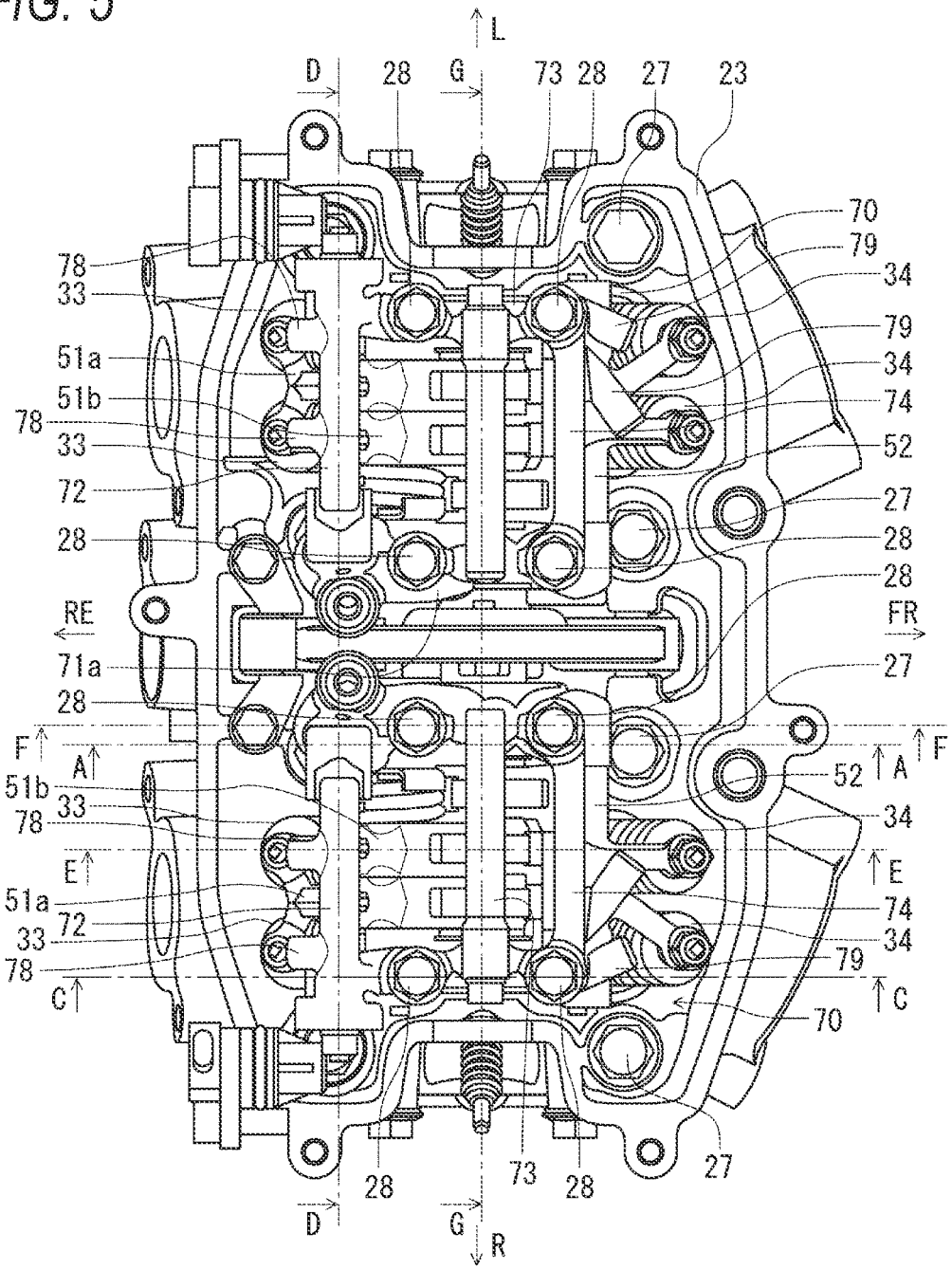
FIG. 5 is a top view of the inside of the cylinder head according to the present embodiment.
Figure 6:
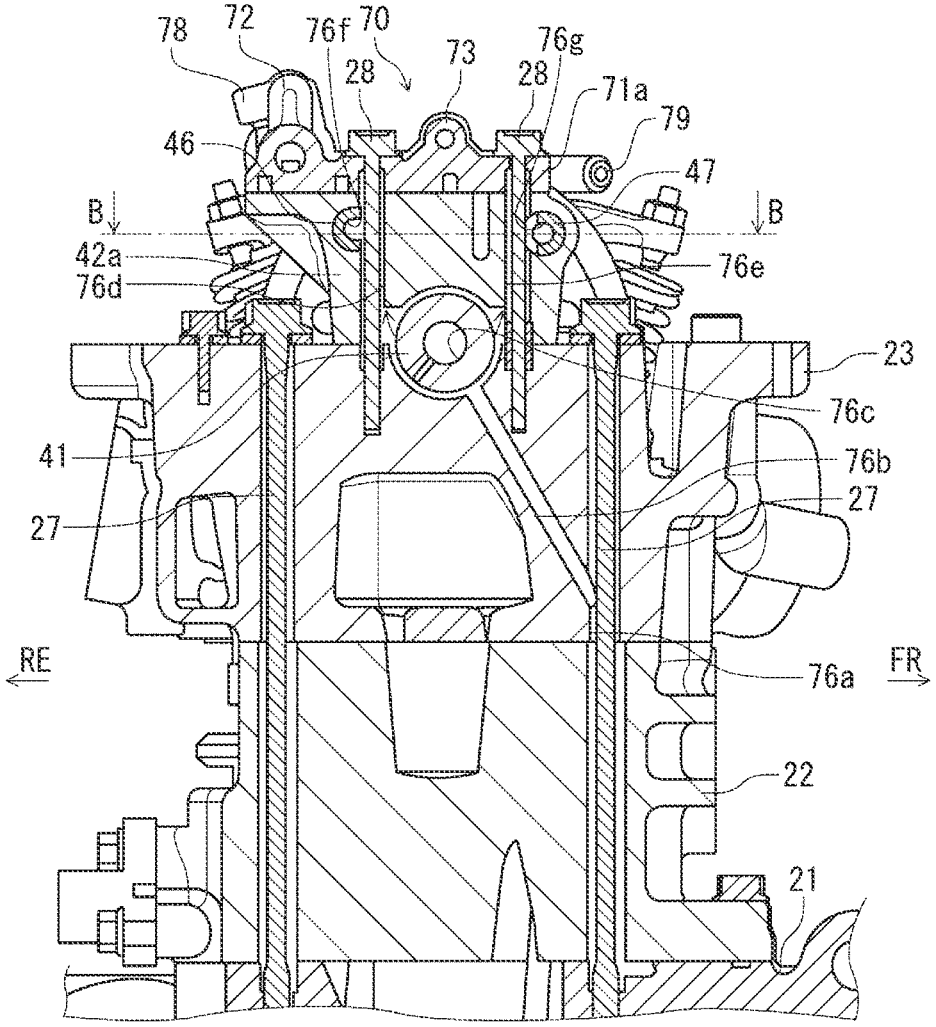
FIG. 6 is a cross-sectional view of the cylinder head in FIG. 5 taken along a line A-A.
Figure 7:
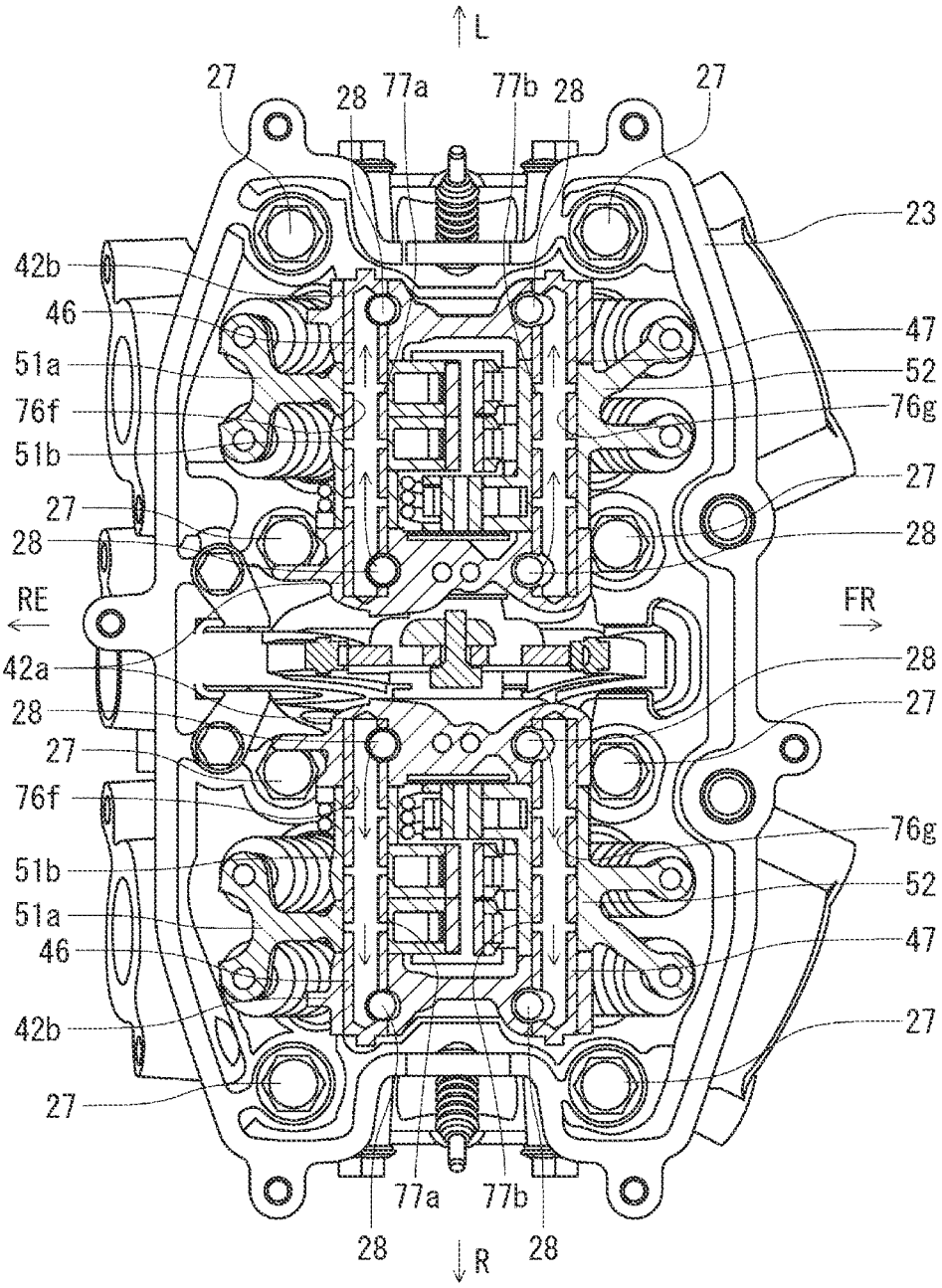
FIG. 7 is a cross-sectional view of the cylinder head in FIG. 6 taken along a line B-B.
Figure 8:
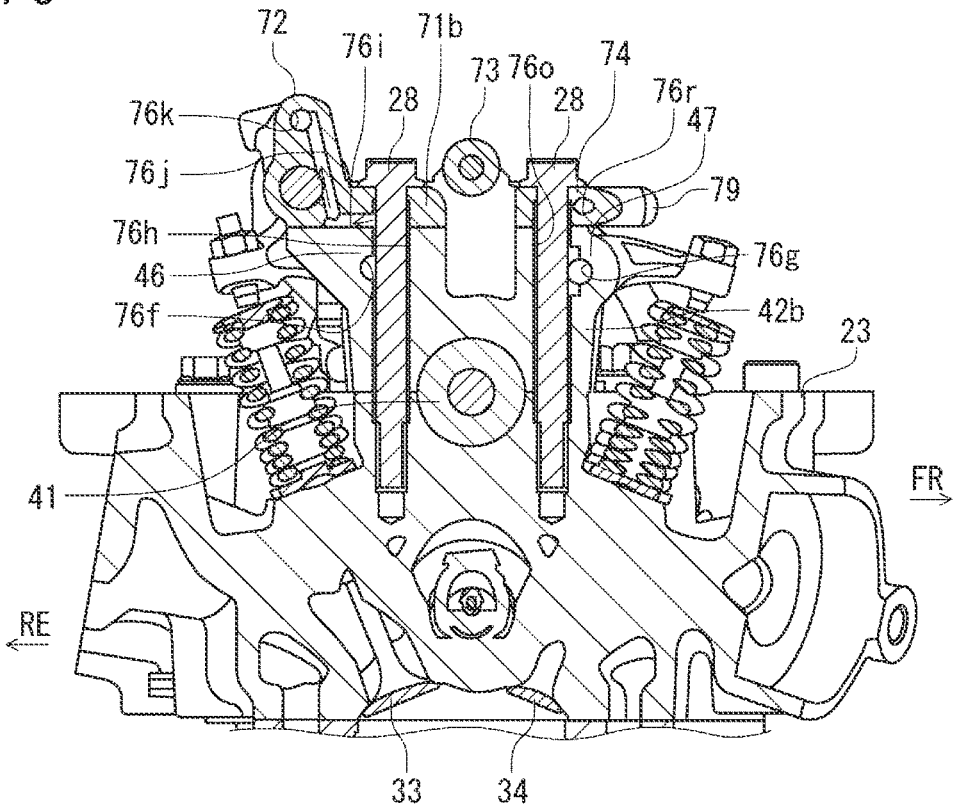
FIG. 8 is a cross-sectional view of the cylinder head in FIG. 5 taken along a line C-C.
Figure 9:
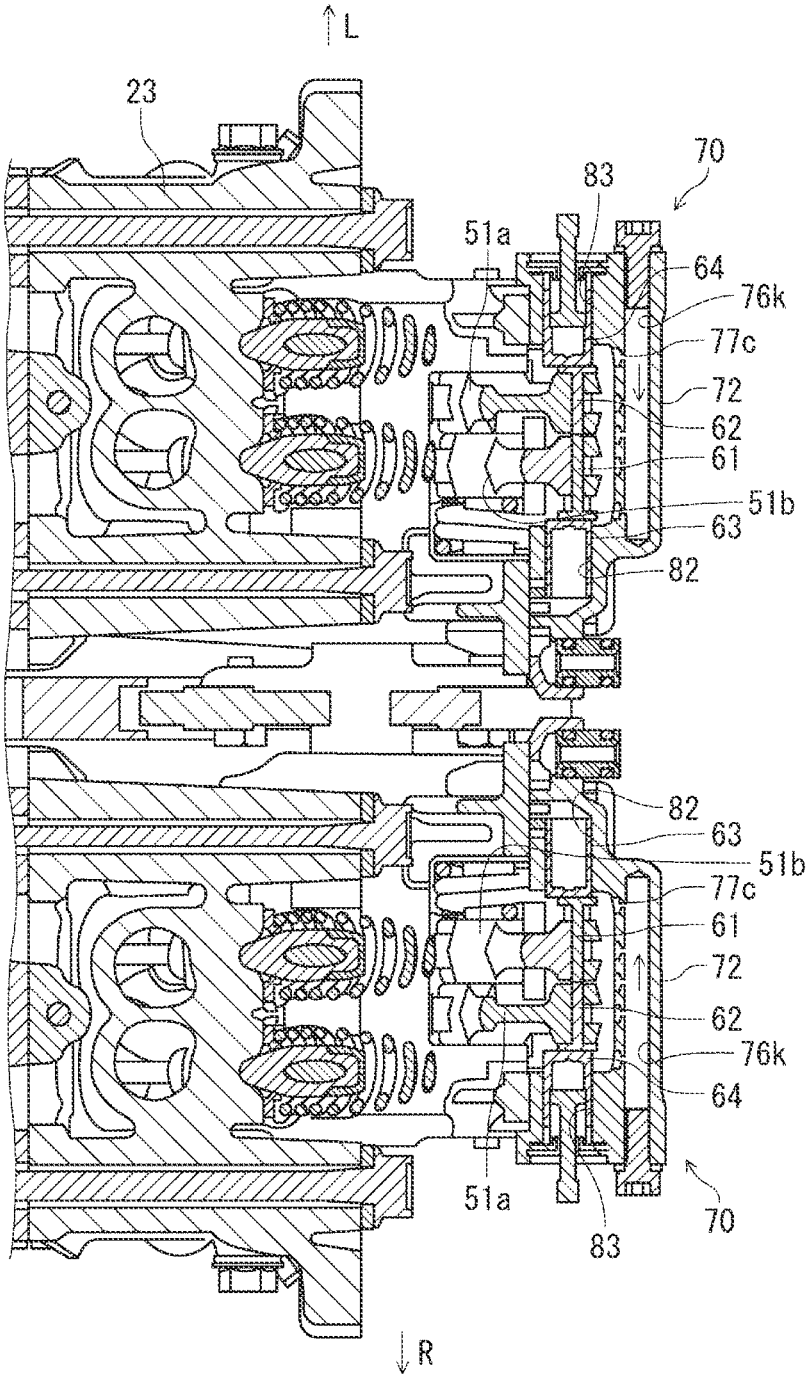
FIG. 9 is a cross-sectional view of the cylinder head in FIG. 5 taken along a line D-D.
Figure 10:
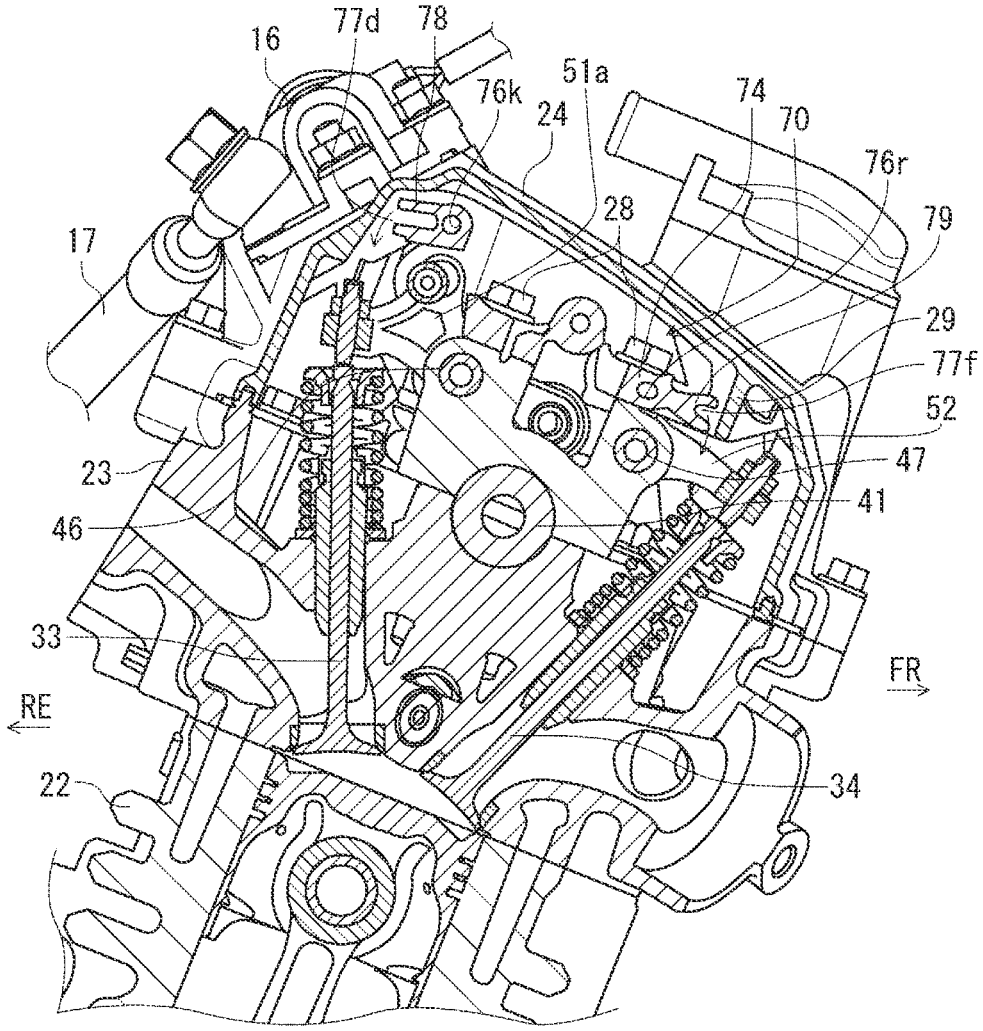
FIG. 10 is a cross-sectional view of the cylinder head in FIG. 5 taken along a line E-E.
Figure 11:
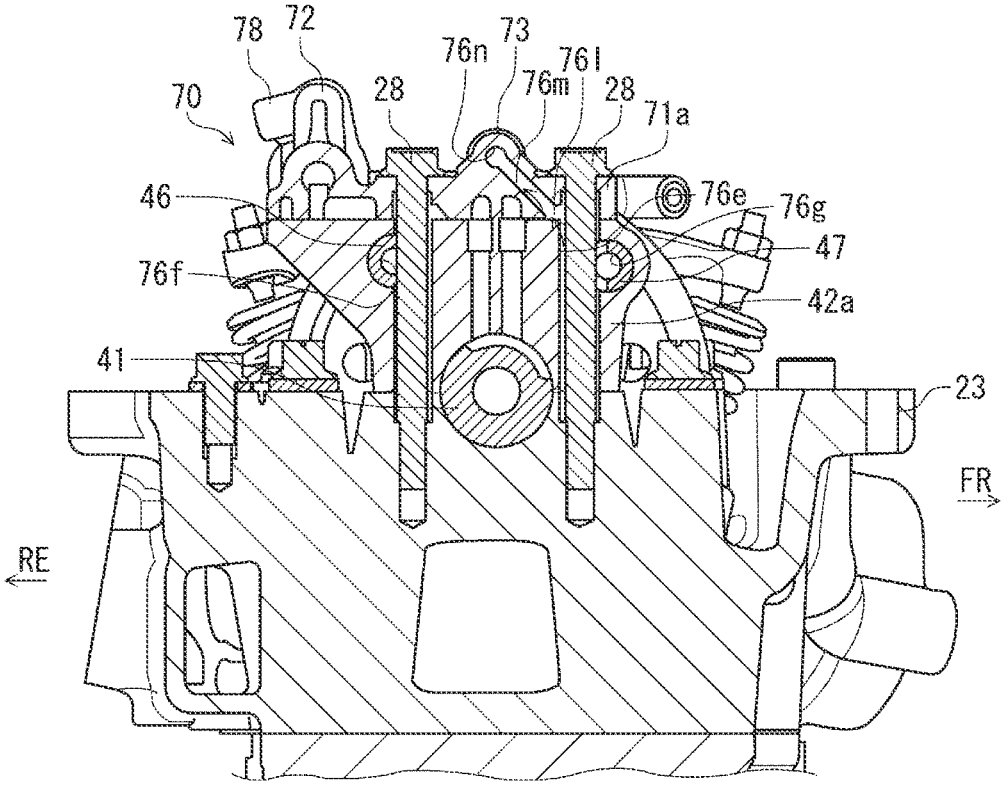
FIG. 11 is a cross-sectional view of the cylinder head in FIG. 5 taken along a line F-F.
Figure 12:
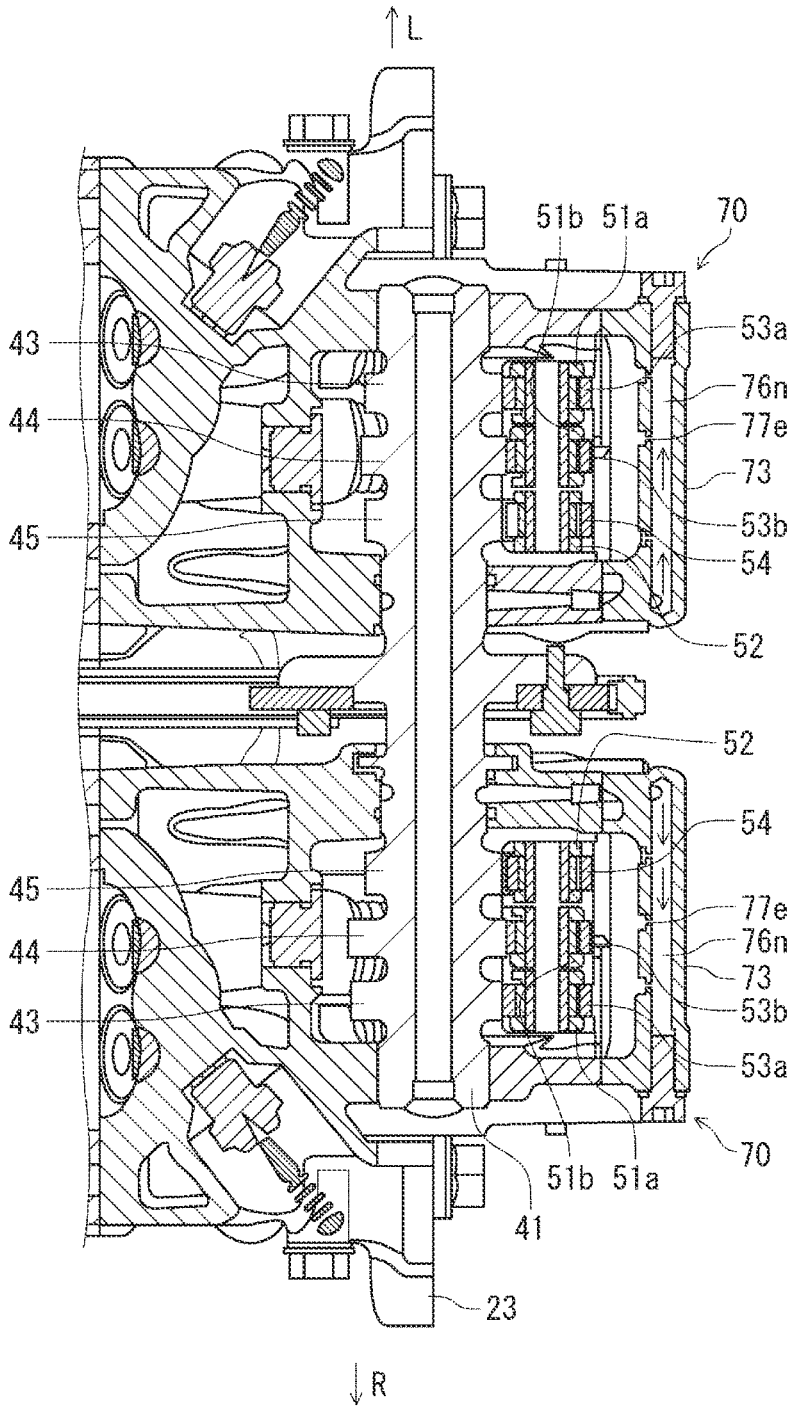
FIG. 12 is a cross-sectional view of the cylinder head in FIG. 5 taken along a line G-G.
Figure 13:
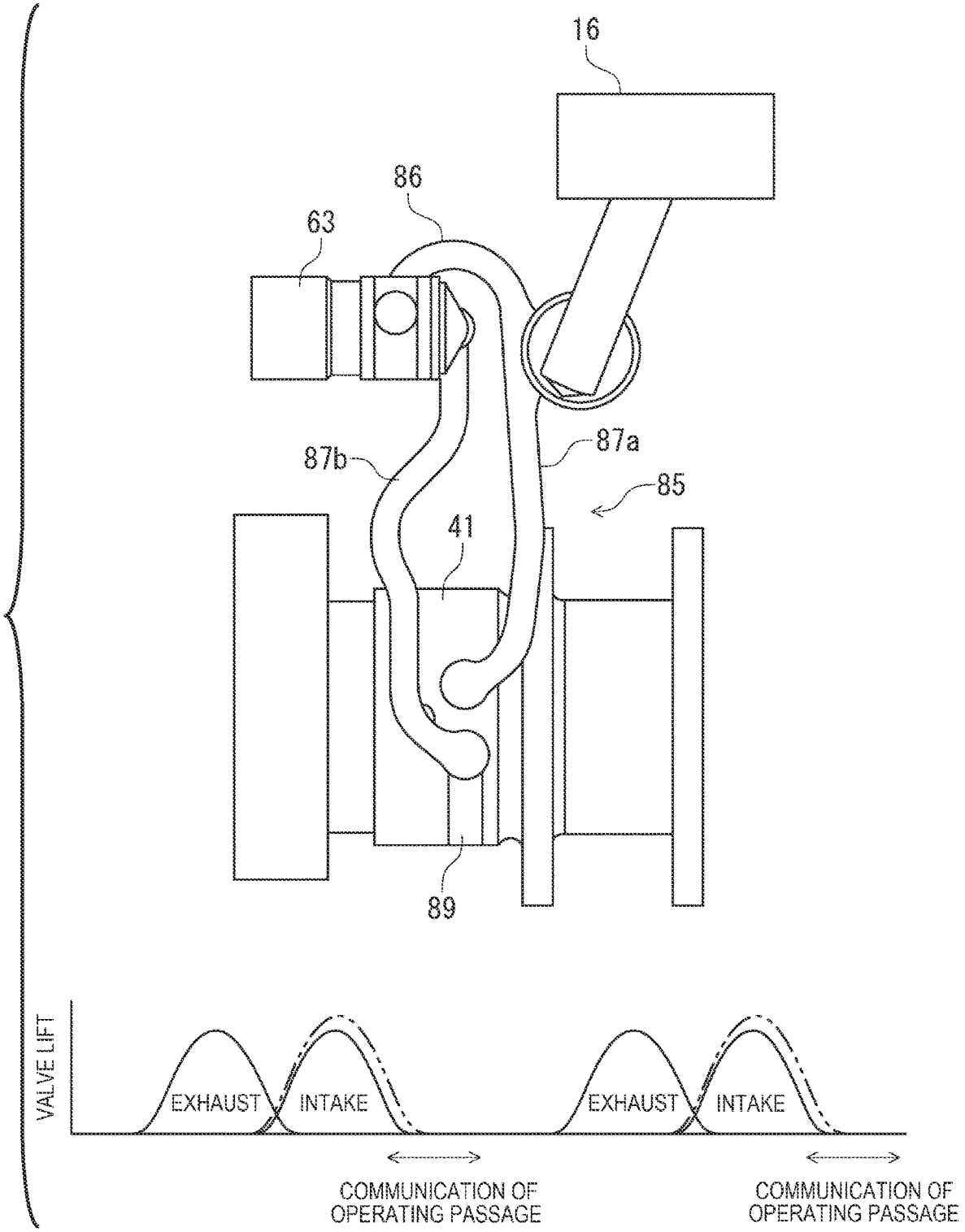
FIG. 13 is a schematic diagram of an operating passage and a short-cut passage according to the embodiment.

Hereinafter, oil passages for lubrication and operation will be described with reference to FIGS. 4A to 13. FIGS. 4A and 4B show a top view and a bottom view of the upper housing according to the present embodiment. FIG. 5 is a top view of the inside of the cylinder head according to the present embodiment. FIG. 6 is a cross-sectional view of the cylinder head in FIG. 5 taken along a line A-A. FIG. 7 is a cross-sectional view of the cylinder head in FIG. 6 taken along a line B-B. FIG. 8 is a cross-sectional view of the cylinder head in FIG. 5 taken along a line C-C. FIG. 9 is a cross-sectional view of the cylinder head in FIG. 5 taken along a line D-D. FIG. 10 is a cross-sectional view of the cylinder head in FIG. 5 taken along a line E-E. FIG. 11 is a cross-sectional view of the cylinder head in FIG. 5 taken along a line F-F. FIG. 12 is a cross-sectional view of the cylinder head in FIG. 5 taken along a line G-G. FIG. 13 is a schematic diagram of an operating passage and a short-cut passage according to the embodiment.

As shown in FIGS. 4A and 4B, the upper housing 70 is formed in the ladder shape by housing fixing portions 71*a* and 71*b* extending in a front-rear direction and first to third bridge portions 72 to 74 extending in a left-right direction. The housing fixing portions 71*a* and 71*b* are fixed to the cam housings 42*a* and 42*b*, respectively (see FIG. 2). The first bridge portion 72 connects the housing fixing portions 71*a* and 71*b* on the intake side of the cylinder head 23. The second bridge portion 73 connects the housing fixing portions 71*a* and 71*b* between the intake side and the exhaust side of the cylinder head 23. The third bridge portion 74 connects the housing fixing portions 71*a* and 71*b* on the exhaust side of the cylinder head 23.

Attachment holes 75*a* and 75*b* are formed in each of the housing fixing portions 71*a* and 71*b*. The housing fixing portions 71*a* and 71*b* are respectively fixed to the cam housings 42*a* and 42*b* between the first bridge portion 72 and the second bridge portion 73 by the attachment holes 75*a*. The housing fixing portions 71*a* and 71*b* are respectively fixed to the cam housings 42*a* and 42*b* at both ends of the third bridge portion 74 by the attachment holes 75*b*. Bolt tightening locations are secured between the first and second bridge portions 72 and 73, and bolt tightening locations are secured at both ends of the third bridge portion 74, so that the upper housing 70 can be fixed to the cam housings 42*a* and 42*b* without increasing a size of the upper housing 70.

The first bridge portion 72 extends along the rocker shaft 46 on the intake side (see FIG. 3), and a lubricating passage 76*k* (see FIG. 9) through which the lubricating oil passes is formed in the first bridge portion 72. A plurality of supply holes 77*c* are formed in a lower surface of the first bridge portion 72, and the plurality of supply holes 77*c* are located above contact locations between components. A pair of nozzles 78 protrude from the first bridge portion 72 to the intake side, and supply holes 77*d* at tips of the pair of nozzles 78 are located above the pair of intake valves 33 (see FIG. 10). The first bridge portion 72 is connected to the housing fixing portions 71*a* and 71*b* via connecting portions 81*a* and 81*b*.

A hydraulic chamber (a first accommodation hole) 82 (see FIGS. 14A and 14B) is formed in the connecting portion 81*a* which is a connecting location between the first bridge portion 72 and the housing fixing portion 71*a*. An accommodation hole (a second accommodation hole) 83 (see FIGS. 14A and 14B) is formed in the connecting portion 81*b* which is a connecting location between the first bridge portion 72 and the housing fixing portion 71*b*. The hydraulic piston 63 (see FIG. 9) serving as a hydraulic piston is disposed in the hydraulic chamber 82, and the spring pin 64 (see FIG. 9) is disposed in the accommodation hole 83. The hydraulic chamber 82 and the accommodation hole 83 are formed coaxially, and the parallelism between the hydraulic piston 63 and the spring pin 64 is ensured. An operating oil is supplied to the hydraulic chamber 82 through a hydraulic circuit different from that for the lubricating oil.

The second bridge portion 73 extends along the camshaft 41 (see FIG. 3), and a lubricating passage 76*n* (see FIG. 12) is formed in the second bridge portion 73. A plurality of supply holes 77*e* are formed in a lower surface of the second bridge portion 73, and the plurality of supply holes 77*e* are located above the rocker arms 51*a*, 51*b*, and 52. The third bridge portion 74 extends along the exhaust rocker shaft 47 on the exhaust side (see FIG. 3). A pair of nozzles 79 protrude from the third bridge portion 74 to the exhaust side, and supply holes 77*f* (see FIG. 10) at tips of the pair of nozzles 79 are located above the pair of exhaust valves 34 (see FIG. 10).

An oil hole 84 is formed on the intake side of the housing fixing portion 71*a*, and an operating oil is supplied from the oil control valve 16 to the oil hole 84. An oil groove is formed in a lower surface of the housing fixing portion 71*a*, and an operating passage (an oil passage) 85 and a short-cut passage (an oil passage) 86 through which the operating oil passes are formed by fixing the housing fixing portion 71*a* to the cam housing 42*a*. The operating passage 85 and the short-cut passage 86 communicate with the hydraulic chamber 82 (see FIGS. 14A and 14B) in which the hydraulic piston 63 is disposed, and the operating oil is supplied from the oil control valve 16 to the hydraulic chamber 82 through the operating passage 85 and the short-cut passage 86.

An oil groove is formed in a center of the housing fixing portion 71*a*, and a lubricating passage 76*l* is formed by fixing the housing fixing portion 71*a* to the cam housing 42*a*. The lubricating oil enters the lubricating passage 76*l* from a camshaft 41 side and is delivered to the second bridge portion 73. An oil groove is formed in a lower surface of the housing fixing portion 71*b*, and a lubricating passage 76*i* is formed by fixing the housing fixing portion 71*b* to the cam housing 42*b*. The lubricating oil enters the lubricating passage 76*i* from the camshaft 41 side and is delivered to the first bridge portion 72. In this way, hydraulic circuits for the lubricating oil and the operating oil are formed in the upper housing 70.

As shown in FIGS. 5 to 7, the cylinder head 23 is fixed to the crankcase 21 via the cylinder 22 by using a plurality of head bolts 27. A gap between the head bolt 27 on the exhaust side and a bolt hole forms a lubricating passage 76*a*, and a lubricating passage 76*b* extends obliquely from the lubricating passage 76*a* to the camshaft 41. The lubricating oil is guided from the crankcase 21 to the periphery of the camshaft 41 through the lubricating passages 76*a* and 76*b*, and the lubricating oil is guided from the periphery of the camshaft 41 to a lubricating passage 76*c* in the camshaft 41. Although the description is omitted, the lubricating oil in the lubricating passage 76*c* is used to lubricate peripheral components of the camshaft 41.

The housing fixing portion 71*a* on one side (a center side in the left-right direction) is fixed to the cylinder head 23 via the cam housing 42*a* by using a pair of housing bolts 28. Gaps between the pair of housing bolts 28 and bolt holes form lubricating passages 76*d* and 76*e* extending from the periphery of the camshaft 41 to the rocker shafts 46 and 47, respectively. The lubricating oil is guided to lubricating passages 76*f* and 76*g* in the rocker shafts 46 and 47 through the lubricating passages 76*d* and 76*e*, respectively. The lubricating oil is supplied from a supply hole 77*a* of the rocker shaft 46 to the rocker arms 51*a* and 51*b* on the intake side, and the lubricating oil is supplied from a supply hole 77*b* of the rocker shaft 47 to the rocker arm 52 on the exhaust side.

As shown in FIG. 8, the housing fixing portion 71*b* on the other side (an outer side in the left-right direction) is fixed to the cylinder head 23 via the cam housing 42*b* by using a pair of housing bolts 28. A gap between the housing bolt 28 on the intake side and a bolt hole forms a lubricating passage 76*h* extending from the other end of the lubricating passage 76*f* of the rocker shaft 46 to the housing fixing portion 71*b*. A lubricating passage 76*j* extends obliquely from the lubricating passage 76*i* on a mating surface between the housing fixing portion 71*b* and the cam housing 42*b* to the first bridge portion 72. The lubricating oil is guided from one end to the other end of the lubricating passage 76*f*, and the lubricating oil is guided to the lubricating passage 76*k* in the first bridge portion 72 through the lubricating passages 76*h* to 76*j*.

As shown in FIGS. 9 and 10, the lubricating oil is supplied from the plurality of supply holes 77*c* of the first bridge portion 72 to contact locations of the hydraulic piston 63, the connecting pin 61, the return pin 62, and the spring pin 64. Contact locations between pin components are lubricated to prevent wear. The pair of nozzles 78 protrude from the first bridge portion 72 to the intake side, and the supply holes 77*d* of the pair of nozzles 78 face an inner wall surface of the cylinder head cover 24. The lubricating oil is blown against the inner wall surface of the cylinder head cover 24 from the supply holes 77*d* of the pair of nozzles 78, and the lubricating oil is supplied to stem ends of the pair of intake valves 33 along the inner wall surface of the cylinder head cover 24.

As shown in FIGS. 11 and 12, a lubricating passage 76*m* extends obliquely from the lubricating passage 76*l* on a mating surface between the housing fixing portion 71*a* and the cam housing 42*a* to the second bridge portion 73. The oil is guided from the periphery of the camshaft 41 to the housing fixing portion 71*a* through the lubricating passage 76*e*, and the lubricating oil is guided to the lubricating passage 76*n* in the second bridge portion 73 through the lubricating passages 76*l* and 76*m*. The lubricating oil is supplied from the plurality of supply holes 77*e* of the second bridge portion 73 to the rollers 53*a*, 53*b*, and 54 of the rocker arms 51*a*, 51*b*, and 52. The rocker arms 51*a*, 51*b*, and 52 are smoothly moved, and the pin components can be appropriately brought into contact with each other.

As shown in FIG. 8, the housing fixing portion 71*b* is fixed to the cylinder head 23 via the cam housing 42*b* by using the pair of housing bolts 28. A gap between the housing bolt 28 on the exhaust side and a bolt hole forms a lubricating passage 76*o* extending from the other end of the lubricating passage 76*g* of the rocker shaft 46 to the housing fixing portion 71*b*. The lubricating oil is guided from one end to the other end of the lubricating passage 76*g*, and the lubricating oil is guided to a lubricating passage 76*r* in the pair of nozzles 79 of the third bridge portion 74 through the lubricating passage 76*o*.

As shown in FIG. 10, the pair of nozzles 79 protrude from the third bridge portion 74 to the exhaust side, and the supply holes 77*f* of the pair of nozzles 79 face a rib 29 of the cylinder head cover 24. The rib 29 of the cylinder head cover 24 is located above the pair of exhaust valves 34. The lubricating oil is blown against the rib 29 of the cylinder head cover 24 from the supply holes 77*f* of the pair of nozzles 79, and the lubricating oil is supplied to stem ends of the pair of exhaust valves 34 along the rib 29 of the cylinder head cover 24. In this way, hydraulic circuits for lubricating the valve components of the variable valve device 40 are formed in the upper housing 70.

As shown in FIG. 13, in the housing fixing portion 71*a* (see FIGS. 4A and 4B), an upstream passage 87*a* of the operating passage 85 extends from the oil control valve 16 toward the camshaft 41, and a downstream passage 87*b* of the operating passage 85 extends from the camshaft 41 toward the hydraulic piston 63. A downstream end of the upstream passage 87*a* and an upstream end of the downstream passage 87*b* are positioned on the same circumference on the outer circumferential surface of the camshaft 41. An oil groove 89 is formed in a circumferential direction on a circumference of the outer circumferential surface of the camshaft 41. The oil groove 89 functions as an operating passage for supplying the operating oil to the hydraulic piston 63 together with the upstream passage 87*a* and the downstream passage 87*b*.

The oil is supplied from the oil control valve 16 to the hydraulic piston 63 only while the upstream passage 87*a* and the downstream passage 87*b* communicate with each other via the oil groove 89. At this time, the oil groove 89 is formed such that the upstream passage 87*a* and the downstream passage 87*b* communicate with each other at an end timing of valve lift, and the upstream passage 87*a* and the downstream passage 87*b* are separated before the start of the valve lift. That is, the oil groove 89 is formed such that the oil starts to be supplied from the oil control valve 16 to the hydraulic piston 63 at the end timing of the valve lift, and the supply of the oil to the hydraulic piston 63 ends before the start of the valve lift.

Since the oil starts to be supplied to the hydraulic piston 63 at the end timing of the valve lift, a connecting operation of the rocker arms 51*a* and 51*b* is not hindered by the valve lift. In addition, since the connecting operation of the rocker arms 51*a* and 51*b* ends before the valve lift starts, the rocker arms 51*a* and 51*b* are not connected during the valve lift. Accordingly, as the camshaft 41 rotates, the oil is intermittently supplied from the oil control valve 16 to the hydraulic piston 63 through the operating passage 85, and the rocker arms 51*a* and 51*b* can be smoothly connected via the connecting pin 61.

The short-cut passage 86 extends directly from the oil control valve 16 to the hydraulic piston 63. The short-cut passage 86 is formed shorter than the operating passage 85. A stepwise oil supply structure with respect to the hydraulic piston 63 is formed such that the oil is supplied from the short-cut passage 86 to the hydraulic piston 63 after the oil is supplied from the operating passage 85 to the hydraulic piston 63. Although the intermittent supply of the oil from the operating passage 85 alone may cause the hydraulic piston 63 to move, the hydraulic piston 63 is stably maintained by directly supplying the oil from the short-cut passage 86.

Figure 14A:
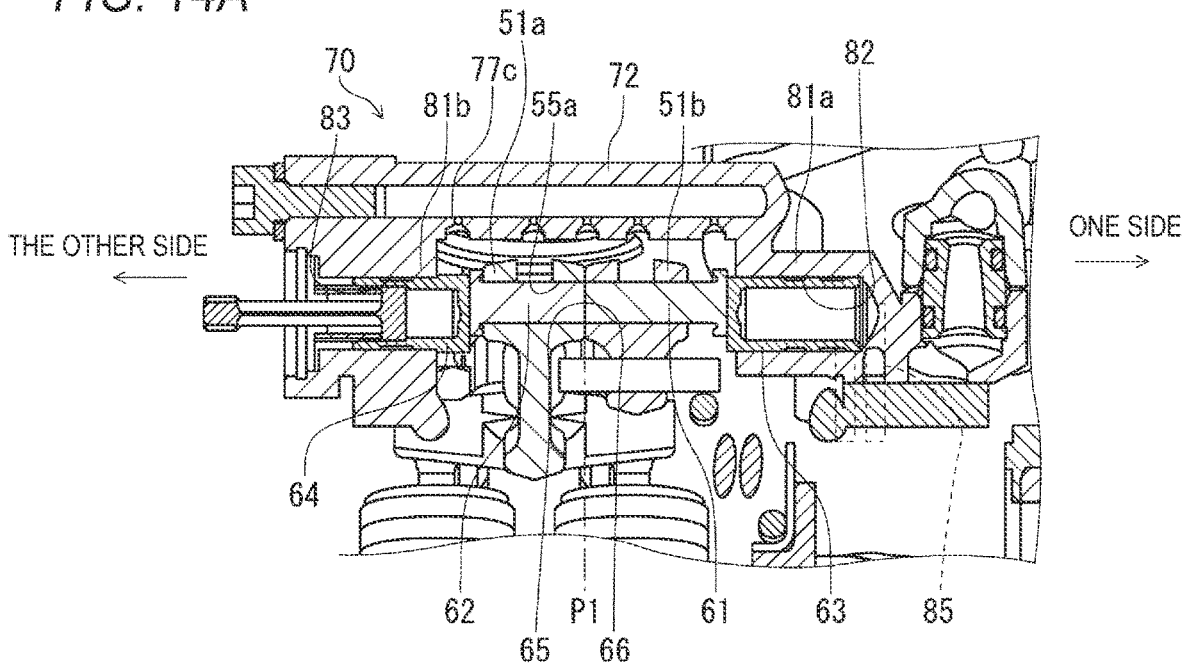
FIGS. 14A and 14B show explanatory views of a connecting operation of the variable valve device according to the present embodiment.
Figure 14B:
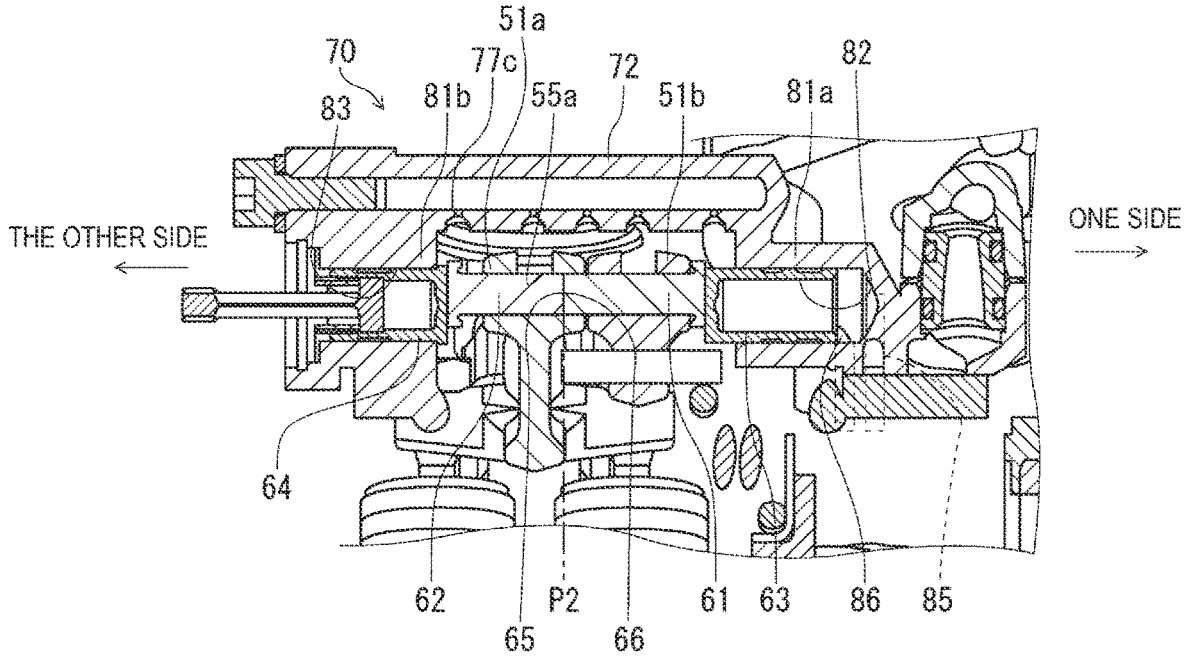

A connecting operation of the variable valve device will be described with reference to FIGS. 14A and 14B. FIGS. 14A and 14B show explanatory views of the connecting operation of the variable valve device according to the present embodiment. In FIGS. 14A and 14B, for convenience of description, reference signs in FIG. 13 are used as appropriate.

As shown in FIG. 14A, in the upper housing 70, the hydraulic chamber 82 is formed in the connecting portion 81*a* on one side with respect to the rocker arm 51*b*, and the accommodation hole 83 is formed in the connecting portion 81*b* on the other side with respect to the rocker arm 51*a*. The hydraulic piston 63 is disposed in the hydraulic chamber 82, and the spring pin 64 is disposed in the accommodation hole 83. The hydraulic piston 63 is in contact with the connecting pin 61 in the rocker arm 51*b*, and the spring pin 64 is in contact with the return pin 62 in the rocker arm 51*a*. Center lines of the hydraulic piston 63 and the spring pin 64 coincide with each other, and wear due to partial contact between components is prevented.

When the engine rotates at a low speed, the oil is not supplied from the oil control valve 16 to the hydraulic chamber 82. No pressing force is applied from the hydraulic piston 63 to the connecting pin 61, and a spring force of the spring pin 64 is applied to the return pin 62. The return pin 62 abuts against the rocker arm 51*a*, and the return pin 62 is positioned at an initial position. At this time, the other end 65 of the connecting pin 61 is in contact with one end 66 of the return pin 62 at a non-connecting position P1 in a gap between the rocker arms 51*a* and 51*b*. The other end 65 of the connecting pin 61 is located outside the rocker arm 51*b*, and the rocker arms 51*a* and 51*b* are separated from each other.

As shown in FIG. 14B, when an engine speed is increased to a predetermined speed or more, the oil starts to be supplied from the oil control valve 16 to the hydraulic chamber 82. As the camshaft 41 rotates, the upstream passage 87*a* and the downstream passage 87*b* of the operating passage 85 intermittently communicate with each other through the oil groove 89, and the oil is intermittently supplied from the operating passage 85 to the hydraulic piston 63. At this time, the oil starts to be supplied at the end timing of the valve lift of the intake valve 33 so as not to hinder the connecting operation of the rocker arms 51*a* and 51*b*. Therefore, the hydraulic piston 63 is smoothly pushed out in an advancing direction with the oil from the operating passage 85.

The connecting pin 61 is pushed in by the hydraulic piston 63, and the spring pin 64 is moved to the other side via the return pin 62 by the connecting pin 61. The other end 65 of the connecting pin 61 is moved to the other side from the non-connecting position P1 to a connecting position P2 in the rocker arm 51*a*. When a part of the connecting pin 61 enters a pin hole 55*a* of the rocker arm 51*a*, the rocker arms 51*a* and 51*b* are connected via the connecting pin 61. A downstream end of the short-cut passage 86 is opened by the movement of the hydraulic piston 63, and a position of the hydraulic piston 63 is maintained by continuous oil supply from the short-cut passage 86.

As shown in FIG. 14A, when the engine speed falls below the predetermined speed, the oil is returned from the hydraulic piston 63 to the oil control valve 16. The pushing of the connecting pin 61 by the hydraulic piston 63 is released, the return pin 62 is pushed back by a repulsive force of the spring pin 64, and the connecting pin 61 is pushed back to the one side by the return pin 62. The other end 65 of the connecting pin 61 is moved to the one side from the connecting position P2 to the non-connecting position P1. When the part of the connecting pin 61 is pulled out from the pin hole 55*a* of the rocker arm 51*a*, the connection of the rocker arms 51*a* and 51*b* is released.

As described above, according to the variable valve device 40 of the present embodiment, when the return pin 62 is pushed to the other side via the connecting pin 61 by the hydraulic piston 63, the connecting pin 61 partially enters the pin hole of the rocker arm 51*a* from the pin hole of the rocker arm 51*b*, so that the rocker arms 51*a* and 51*b* are connected. When the connecting pin 61 is pushed back to the one side via the return pin 62 by the spring pin 64, the connecting pin 61 is pulled out from the pin hole of the rocker arm 51*a*, so that the connection of the rocker arms 51*a* and 51*b* is released. In this way, the connected state and a released state of the rocker arms 51*a* and 51*b* can be switched with a simple configuration. In addition, since the hydraulic chamber 82 and the accommodation hole 83 are formed in the upper housing 70, a parallelism between the components is easily achieved, and the wear due to the partial contact between the components is prevented.

In the present embodiment, the pair of rocker arms are provided on the intake side of the variable valve device, but a plurality of rocker arms may be provided on the intake side of the variable valve device. For example, three or more rocker arms may be provided on the intake side of the variable valve device.

In the present embodiment, the hydraulic piston is shown as an example of the pressing member, but the pressing member may be a member that causes the connecting pin to push the return pin to the other side.

In the present embodiment, the spring pin is shown as an example of the repulsive member, but the repulsive member may be a member that causes the return pin to push back the connecting pin to the one side.

In the present embodiment, the upper housing includes the first to third bridge portions, but the upper housing may be formed in a manner of being supported at both ends by the upper surfaces of the pair of cam housings.

In the present embodiment, the hydraulic chamber (the first accommodation hole) is formed in the connecting portion on the one side of the upper housing, but the hydraulic chamber may be formed on one side with respect to a rocker arm closer to one side in the upper housing. Similarly, the accommodation hole (the second accommodation hole) is formed in the connecting portion on the other side of the upper housing, but the accommodation hole may be formed on the other side with respect to a rocker arm closer to the other side in the upper housing.

In the present embodiment, a flange pin is used for the connecting pin and the return pin, but a straight pin may be used for the connecting pin and the return pin.

In the present embodiment, the seesaw-type rocker arm is shown as an example, but a type of the rocker arm is not particularly limited, and the rocker arm may be of a finger follower type.

In the present embodiment, the plurality of rocker arms are adjacent to each other, but the plurality of rocker arms may be separated from each other.

In the present embodiment, the operating passage and the short-cut passage are formed in the upper housing, but an oil passage capable of supplying the operating oil to the hydraulic piston may be formed in the cylinder head.

An exhaust device according to the present embodiment is not limited to the engine of the straddle-type vehicle described above, and may be adopted for an engine of another vehicle. The straddle-type vehicle is not limited to a motorcycle, and may be any vehicle on which an engine is mounted. The straddle-type vehicle is not limited to general vehicles on which a driver rides in a posture of straddling a seat, and includes a scooter-type vehicle on which the driver rides without straddling the seat.

As described above, a first aspect relates to a variable valve device (40) capable of changing valve operations of an intake valve (33) and an exhaust valve (34) in a cylinder head (23), the variable valve device including: a pair of cam housings (42*a*, 42*b*) separated in a predetermined direction in the cylinder head; a rocker shaft (46) supported by opposing portions of the pair of cam housings; a plurality of rocker arms (51*a*, 51*b*) swingably supported by the rocker shaft; a connecting pin (61) disposed in a pin hole of a rocker arm closer to one side in a predetermined direction; a return pin (62) disposed in a pin hole of a rocker arm closer to the other side in the predetermined direction; a pressing member (the hydraulic piston 63) configured to cause the connecting pin to push the return pin to the other side; a repulsive member (the spring pin 64) configured to cause the return pin to push back the connecting pin to one side; and an upper housing (70) supported at both ends by upper surfaces of the pair of cam housings, in which the upper housing is formed with a first accommodation hole (the hydraulic chamber 82) in which the pressing member is disposed on one side with respect to the rocker arm closer to one side, and a second accommodation hole (the accommodation hole 83) in which the repulsive member is disposed on the other side with respect to the rocker arm closer to the other side. According to this configuration, when the return pin is pushed to the other side via the connecting pin by the pressing member, the connecting pin partially enters from the pin hole of the rocker arm closer to one side into the pin hole of the rocker arm closer to the other side, so that the plurality of rocker arms are connected. When the connecting pin is pushed back to the one side via the return pin by the repulsive member, the connecting pin is pulled out from the pin hole of the rocker arm closer to the other side, so that the connection of the plurality of rocker arms is released. In this way, a connected state and a released state of the plurality of rocker arms can be switched with a simple configuration. In addition, since the first accommodation hole and the second accommodation hole are formed in the upper housing, a parallelism between components is easily achieved, and wear due to partial contact between the components is prevented.

In a second aspect according to the first aspect, the upper housing includes a pair of housing fixing portions (71*a*, 71*b*) fixed to the pair of cam housings, and a first bridge portion (72) that is located on an intake side of the cylinder head and connects the pair of housing fixing portions, and the first accommodation hole is formed in a connecting location (the connecting portion 81*a*) between one housing fixing portion and the first bridge portion, and the second accommodation hole is formed in a connecting location (the connecting portion 81*b*) between the other housing fixing portion and the first bridge portion. According to this configuration, a rigidity around the first accommodation hole and the second accommodation hole is increased, and a parallelism between the first accommodation hole and the second accommodation hole is easily achieved.

In a third aspect according to the second aspect, the first bridge portion is formed with a plurality of supply holes (77*c*) configured to allow a lubricating oil to be supplied to contact locations of the connecting pin, the return pin, the pressing member, and the repulsive member. According to this configuration, the contact locations of the connecting pin, the return pin, the pressing member, and the repulsive member can be lubricated to prevent the wear.

In a fourth aspect according to the second aspect or the third aspect, the first bridge portion is formed with a supply hole (77*d*) configured to allow a lubricating oil to be supplied to a stem end of the intake valve. According to this configuration, the stem end of the intake valve can be lubricated.

In a fifth aspect according to any one of the second aspect to the fourth aspect, the upper housing includes a second bridge portion (73) that is located between the intake side and an exhaust side of the cylinder head and connects the pair of housing fixing portions, and the pair of housing fixing portions are fixed to the pair of cam housings between the first bridge portion and the second bridge portion. According to this configuration, a rigidity of the upper housing can be increased by the second bridge portion. In addition, it is possible to secure bolt tightening locations between the first and second bridge portions and fix the upper housing to the cam housings without increasing a size of the upper housing.

In a sixth aspect according to the fifth aspect, the second bridge portion is formed with a plurality of supply holes (77*e*) configured to allow a lubricating oil to be supplied to the plurality of rocker arms. According to this configuration, the rocker arms can be lubricated. Since the rocker arms are smoothly moved, pin components can be appropriately brought into contact with each other.

In a seventh aspect according to any one of the second aspect to the sixth aspect, the upper housing includes a third bridge portion (74) that is located on an exhaust side of the cylinder head and connects the pair of housing fixing portions, and the pair of housing fixing portions are fixed to the pair of cam housings at both ends of the third bridge portion. According to this configuration, the rigidity of the upper housing can be increased by the third bridge portion. In addition, it is possible to secure bolt tightening locations at both ends of the third bridge portion and fix the upper housing to the cam housings without increasing the size of the upper housing.

In an eighth aspect according to the seventh aspect, the third bridge portion is formed with a supply hole (77*f*) configured to allow a lubricating oil to be supplied to a stem end of the exhaust valve. According to this configuration, the stem end of the exhaust valve can be lubricated.

In a ninth aspect according to any one of the second aspect to the eighth aspect, the pressing member is a hydraulic piston configured to be operated with a hydraulic pressure, and a mating surface of the pair of cam housings and the pair of housing fixing portions is formed with an oil passage (the operating passage 85, the short-cut passage 86) configured to allow an operating oil to be supplied to the hydraulic piston. According to this configuration, the oil passage can be formed in a compact manner using the mating surface of the pair of cam housings and the pair of housing fixing portions.

Although the present embodiment has been described, the above-described embodiment and modification may be combined entirely or partially as another embodiment.

The technique of the present invention is not limited to the above-described embodiment, and various changes, substitutions, and modifications may be made without departing from the spirit of the technical idea of the present invention. The present invention may be implemented using other methods as long as the technical idea can be implemented by the methods through advance of the technique or other derivative techniques. Accordingly, the claims cover all embodiments that may be included within the scope of the technical idea.

What is claimed is:

1. A variable valve device capable of changing valve operations of an intake valve and an exhaust valve in a cylinder head, the variable valve device comprising:

a pair of cam housings separated in a predetermined direction in the cylinder head;

a rocker shaft supported by opposing portions of the pair of cam housings;

a plurality of rocker arms swingably supported by the rocker shaft;

a connecting pin disposed in a pin hole of a rocker arm closer to one side in a predetermined direction;

a return pin disposed in a pin hole of a rocker arm closer to the other side in the predetermined direction;

a pressing member configured to cause the connecting pin to push the return pin to the other side;

a repulsive member configured to cause the return pin to push back the connecting pin to one side; and an upper housing supported at both ends by upper surfaces of the pair of cam housings, wherein the upper housing is formed with a first accommodation hole in which the pressing member is disposed on one side with respect to the rocker arm closer to one side and a second accommodation hole in which the repulsive member is disposed on the other side with respect to the rocker arm closer to the other side.

2. The variable valve device according to claim 1, wherein the upper housing includes a pair of housing fixing portions fixed to the pair of cam housings, and a first bridge portion that is located on an intake side of the cylinder head and connects the pair of housing fixing portions, and the first accommodation hole is formed in a connecting location between one housing fixing portion and the first bridge portion, and the second accommodation hole is formed in a connecting location between the other housing fixing portion and the first bridge portion.

3. The variable valve device according to claim 2, wherein the first bridge portion is formed with a plurality of supply holes configured to allow a lubricating oil to be supplied to contact locations of the connecting pin, the return pin, the pressing member, and the repulsive member.

4. The variable valve device according to claim 2, wherein the first bridge portion is formed with a supply hole configured to allow a lubricating oil to be supplied to a stem end of the intake valve.

5. The variable valve device according to claim 2, wherein the upper housing includes a second bridge portion that is located between the intake side and an exhaust side of the cylinder head and connects the pair of housing fixing portions, and the pair of housing fixing portions are fixed to the pair of cam housings between the first bridge portion and the second bridge portion.

6. The variable valve device according to claim 5, wherein the second bridge portion is formed with a plurality of supply holes configured to allow a lubricating oil to be supplied to the plurality of rocker arms.

7. The variable valve device according to claim 2, wherein the upper housing includes a third bridge portion that is located on an exhaust side of the cylinder head and connects the pair of housing fixing portions, and the pair of housing fixing portions are fixed to the pair of cam housings at both ends of the third bridge portion.

8. The variable valve device according to claim 7, wherein the third bridge portion is formed with a supply hole configured to allow a lubricating oil to be supplied to a stem end of the exhaust valve.

9. The variable valve device according to claim 2, wherein the pressing member is a hydraulic piston configured to be operated with a hydraulic pressure, and a mating surface of the pair of cam housings and the pair of housing fixing portions is formed with an oil passage configured to allow an operating oil to be supplied to the hydraulic piston.

* * * * *